US006764300B2

(12) United States Patent
Sewalt

(10) Patent No.: US 6,764,300 B2
(45) Date of Patent: Jul. 20, 2004

(54) CHILD RESISTANT GAS LIGHTERS

(75) Inventor: Carel Sewalt, Onstwedde (NL)

(73) Assignee: Swedish Match Lighters B.V., AM Assen (NL)

( * ) Notice: Subject to any disclaimer, the term of this patent is extended or adjusted under 35 U.S.C. 154(b) by 0 days.

(21) Appl. No.: 10/204,124

(22) PCT Filed: Feb. 26, 2001

(86) PCT No.: PCT/IB01/00418

§ 371 (c)(1),
(2), (4) Date: Aug. 14, 2002

(87) PCT Pub. No.: WO01/65183

PCT Pub. Date: Sep. 7, 2001

(65) Prior Publication Data

US 2003/0022117 A1 Jan. 30, 2003

(30) Foreign Application Priority Data

Mar. 2, 2000 (GB) ..... 0004947
Mar. 2, 2000 (GB) ..... 0004948

(51) Int. Cl.[7] ..... F23Q 7/24; F23D 11/36
(52) U.S. Cl. ..... 431/153; 431/277
(58) Field of Search ..... 431/255, 153, 431/277, 344

(56) References Cited

U.S. PATENT DOCUMENTS 3,063,276 A * 11/1962 Cassan ..... 431/254
5,483,978 A * 1/1996 Doiron ..... 131/329
5,490,773 A * 2/1996 Lloveras Capilla ..... 431/153
5,520,197 A * 5/1996 McDonough et al. ..... 131/329
5,584,683 A * 12/1996 Sher ..... 431/153
5,735,294 A * 4/1998 McDonough et al. ..... 131/329
5,769,625 A * 6/1998 Sher ..... 431/153
5,957,680 A * 9/1999 Doucet et al. ..... 431/153
6,123,541 A * 9/2000 Yang ..... 431/153
6,343,928 B1 * 2/2002 Liang ..... 431/153
6,485,291 B2 * 11/2002 Adams ..... 431/153
6,488,493 B2 * 12/2002 Sung ..... 431/153
6,565,354 B2 * 5/2003 Liang ..... 431/153
6,612,831 B1 * 9/2003 Ansquer et al. ..... 431/153
6,612,832 B1 * 9/2003 Huang ..... 431/153
2002/0090586 A1 * 7/2002 Adams ..... 431/153
2002/0119410 A1 * 8/2002 Sewalt ..... 431/153
2002/0155407 A1 * 10/2002 Li ..... 431/153
2003/0031968 A1 * 2/2003 Sewalt ..... 431/153

FOREIGN PATENT DOCUMENTS

EP 1 092 924 4/2001
FR 2568353 A1 * 1/1986 ..... F23Q/2/46
JP 05106838 A * 4/1993 ..... F23Q/2/16
WO WO 95/04247 2/1995

* cited by examiner

*Primary Examiner*—Henry Bennett
*Assistant Examiner*—Kathryn Odland
(74) *Attorney, Agent, or Firm*—Herbert Dubno

(57) ABSTRACT

A roll and press gas lighter is rendered child resistant by a protective strip (26, 35) which extends around the spark-wheel (15) and impedes the action of the user's thumb. The wheel assembly (13) is mounted for reciprocal motion and upwardly biased by the flint spring (19), and is depressed by the user during operation. The thumbwheel (16) may have a smooth periphery to increase the force required to rotate it.

7 Claims, 8 Drawing Sheets

CHILD RESISTANT GAS LIGHTERS

CROSS REFERENCE TO RELATED APPLICATIONS

This application is the a national stage of PCT/IB01/00418 filed 26 Feb. 2001 and based upon the UK national applications 0004947.8 and 0004948.6 of 2 Mar. 2000 under the International Convention.

FIELD OF THE INVENTION

The present invention relates to gas lighters of the "roll and press" type, and more specifically to child resistant lighters.

BACKGROUND OF THE INVENTION

Roll and press gas lighters of the type used for lighting cigarettes are well known. A lighter of this type has a gas reservoir, a gas regulation system including a valve opened and closed by a lever, and a wheel ignition mechanism. The ignition mechanism preferably comprises a spark-wheel disposed midway between two thumb-wheels of larger diameter than the spark-wheel. The spark-wheel rubs frictionally against a flint when rotated, in order to project sparks above the opened burner and ignite the gas, producing a flame. Such lighters are often provided with a cap or shield around the fuel jet with a tongue passing over the spark-wheel in order to avoid the user's thumb becoming soiled with flint dust.

It is important to prevent the use of such lighters by children under the age of 5 years. The standard for child resistance has been specified in the USA by means of a functional test by the Consumer Product Safety Commission: 16 CFR Parts 1145 and 1210, Risks of Injury Associated with Lighters That Can Be Operated by Children: Safety Standard for Cigarette Lighters; Rules: Federal Register, Monday Jul. 12 1993. The degree to which a lighter is child resistant may be objectively determined by applying the test described in these Rules and Regulations.

Many child resistant lighter mechanisms have been proposed. There are two broad techniques for child resistance. Most systems use a lever mechanism having two positions; one where the mechanism is prevented from working (the lighter cannot function properly), and a second where the mechanism is manipulated (by displacement, pivoting, etc) to a position where the lighter can function and produce a flame. The mechanism must reset automatically to its original "safe" position after the lighter has been used. In the other type of mechanism, the unlocking system is in the wheel assembly area in order to minimize the time the user takes to learn how to operate it. Usually, the mechanical interlocking means as described above involve properties or parts which make operation of the lighter difficult for children while remaining easy for adults.

An example of the latter type of system is described in WO 95/04247, BIC. In this patent, there is a resilient blade or guard mounted around the spark-wheel to prevent the access of the thumb to the wheel assembly unless the user presses downwards hard enough to depress the blade below the level of the thumb-wheels. Depending on the height of the blade, using this lighter is more or less uncomfortable for the user, and care must therefore be taken to ensure that the blade characteristics are maintained within an acceptable range during production. Furthermore, the protruding blade is vulnerable to removal by the user with an external tool such as a screwdriver.

FR A-2417722 discloses a guard or blade member which extends over the spark wheel to improve the aesthetic appearance and to protect the top part of the lighter. It also prevents contact of the user's thumb with the spark wheel which may cause the thumb to become dirty.

FR 95 08011 to the present applicant discloses a child resistant lighter whose thumbwheels are provided with smooth edges, requiring a greater pressure from the user's thumb to operate the lighter than can be exerted by a child.

Lighters are typically manufactured in very large numbers, and it is important that the degree of child resistance, and hence the degree of difficulty which the adult user will experience in using the lighter, should be maintained within closely defined limits for each unit produced.

However, the prior art methods described above do not readily admit of fine adjustment of the degree of child resistance during prototyping and production. It is difficult to accurately and economically control and adjust the resilience of a stamped or pressed metal strip or the frictional characteristics of the smooth periphery of a thumbwheel, and it is therefore difficult to accurately specify the degree of child resistance by reference to these characteristics.

OBJECT OF THE INVENTION

The object of the present invention is to provide an improved gas lighter which offers a consistent and reliable combination of child resistance with ease of use by the adult user.

SUMMARY OF THE INVENTION

Accordingly the present invention provides a child resistant lighter of the roll and press type including a wheel assembly having a spark wheel and thumbwheel means, and further including a shield having a protective strip around the wheel assembly and interacting therewith to make the wheel assembly difficult for children to rotate, characterized in that the wheel assembly is resiliently mounted for downward movement so that the user has to press the wheel assembly downwards before it can be rotated.

The present invention, in its preferred embodiment, provides a child resistant lighter which can be conveniently operated and which requires no significant learning effort on the part of the user, and in which the possibility of inadvertent ignition other than by the correct specified method is small.

BRIEF DESCRIPTION OF THE DRAWING

Various lighters embodying various forms of the invention will now be described, by way of example, with reference to the drawing, in which.

Corresponding parts are referred to by the same reference numerals in each of the Figures.

SPECIFIC DESCRIPTION

Figure 1A:
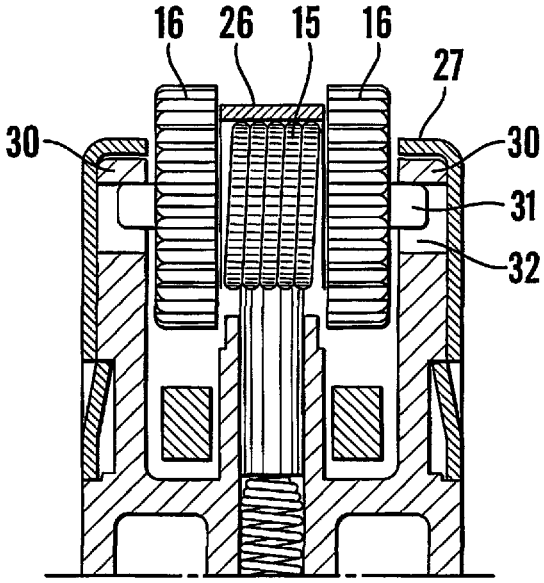
FIGS. 1A and 1B are end and side cross sectional views of a first lighter in the rest position.
Figure 1B:
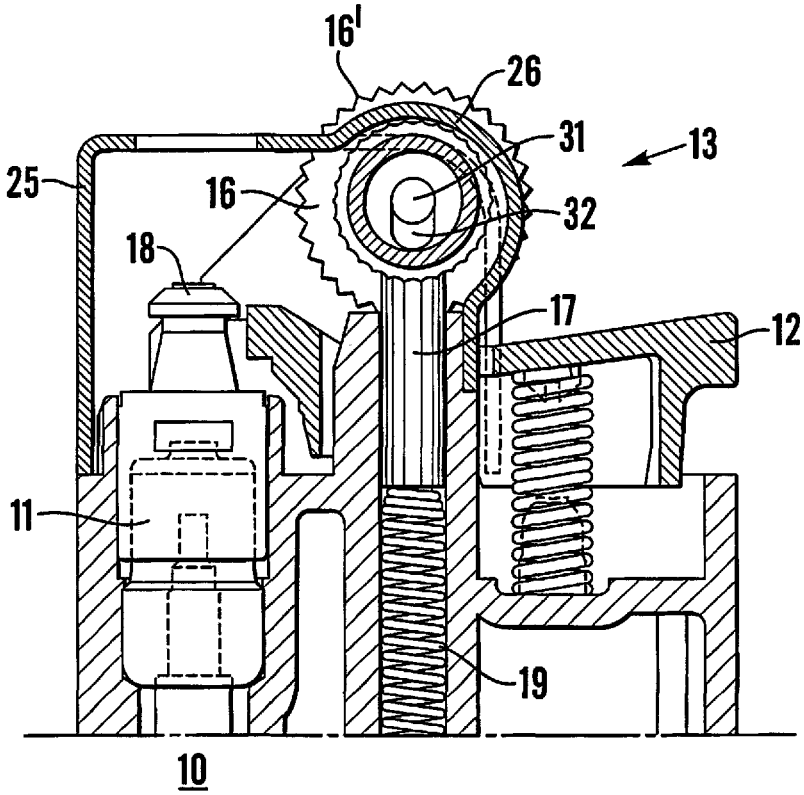

Referring to FIGS. 1A and 1B, the lighter has a gas reservoir 10, a gas regulation system including a valve open/close system 11 lifted and closed by a lever 12, and a wheel ignition mechanism 13. The ignition mechanism comprises a spark wheel 15 disposed midway between two thumb wheels 16 whose diameter is larger than that of the spark wheel. The spark wheel rubs frictionally against a flint 17 when rotated, in order to project sparks above the opened burner or jet 18 and therefore to produce a flame. The flint 17 is urged against the spark wheel by a spring 19. The lighter also has a cap or shield 25 around the fuel jet which has a tongue 26 passing over the spark wheel.

The shield extension or tongue 26 lies above the spark wheel 15 but between the thumb wheels 16. The tongue 26 can be made integral or in two parts. It may be formed as a conventional non-embellishing cap with an added blade going from the back side of the lighter from close (or attached) to the flint cavity and finishing on the front part of the cap.

The wheel assembly 13 is mounted in a pair of ears 30 of the lighter. Specifically, the wheel assembly comprises the spark wheel 15 and the thumb wheels 16 mounted on an axle 31 which is supported in a pair of oversized or oval holes 32 in the ears 30. In the rest position, the axle 31 of the wheel assembly lies at the top of the oversized holes 32 because of the force of the spring 19 through the flint 17 exerted constantly upward on the wheel assembly 13.

The oversized holes 32 are in the form of slots which may be arranged vertically constraining the thumbwheels in a downwards direction. The slots could also be arranged at an angle to the longitudinal axis of the body of the lighter, thus constraining the movement of the thumbwheels in a generally inward and downward direction.

Figure 2A:
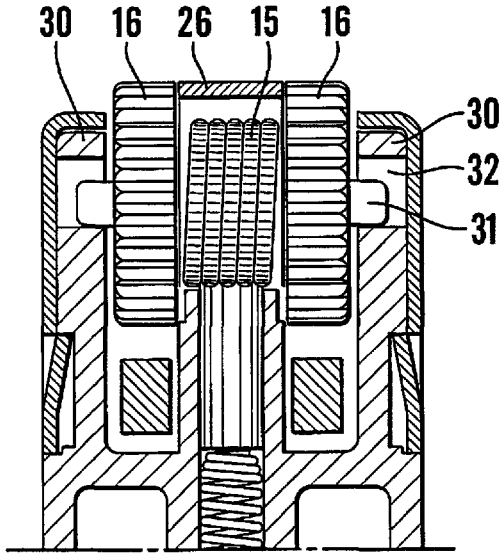
FIGS. 2A and 2B are corresponding views of the lighter in the operated position.
Figure 2B:
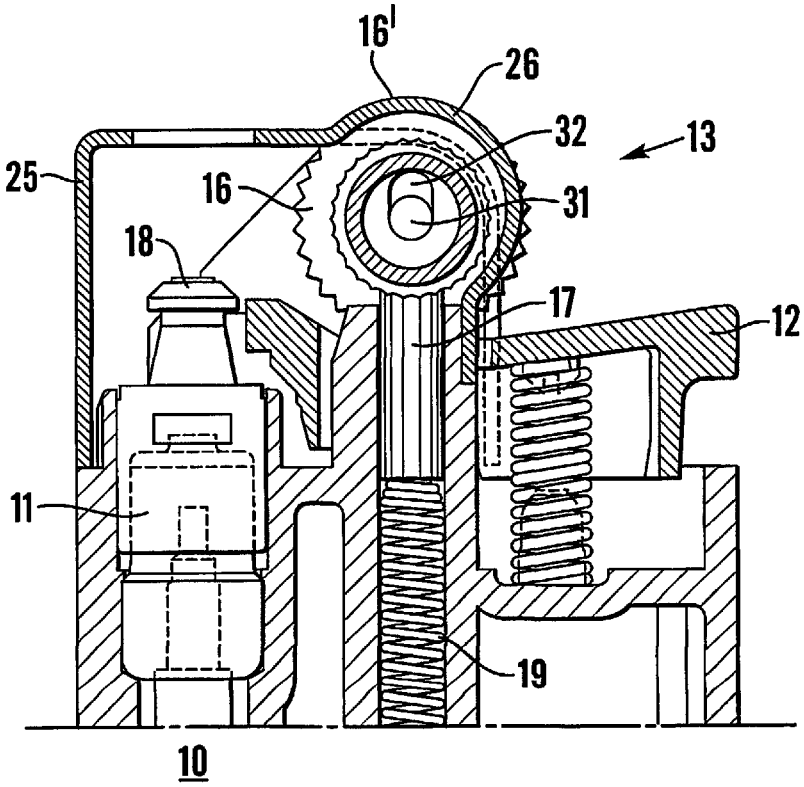

In order to activate the lighter, the user will need to depress the thumbwheel of the wheel assembly 13 as shown in FIGS. 2A and 2B. The user will contact and press the digit (usually the thumb) against the thumb wheels 16 order to grip the thumb wheels 16 and cause them to be depressed against the restoring action of the flint spring 19. The axle 31 of the wheel assembly correspondingly moves downwards in the elongate hole 32, as shown in FIG. 2B. The user's thumb then contacts the tongue 26 of the cap 25.

In a first preferred embodiment, the tongue 26 is essentially rigid, being stiff enough to resist deflection by the user's thumb, in which case the user's thumb acts against the tongue 26 of the cap 25 but does not cause it to move significantly. Instead the pulp of the user's thumb will deform around the edges of the tongue 26 and exert a downward force against the thumb-wheels 16. The thumb wheel will move further downwardly due to the length of the elongate hole 32, while the tongue remains above the contacting surfaces of the thumb wheel.

When the wheel assembly axle 31 has reached the bottom part of the hole 32, rotation can be achieved despite the tongue 26 by means of the pulp of the user's thumb gripping the thumb wheel. Sufficient force must then be applied by the user to overcome the friction between the digit and the tongue. This operation of downwards pressing followed by rotation of the thumb wheel is the same action as for conventional roll and press lighters and is an action the user is used to making. The user will therefore hardly notice that the lighter is a child resistant lighter and will not be disinclined to use the lighter. However if a child tries to use the lighter, the child's thumb will not be sufficiently large or have sufficient pulp to deform on either side of the tongue 26 and contact the thumb wheel to a sufficient extent to grip and rotate it. The child must also overcome the friction between the digit and the tongue, and will be unable to exert sufficient pressure on the thumbwheel to induce rotation. For some or all of these reasons it will therefore be very difficult for a child to ignite the lighter.

Figure 3A:
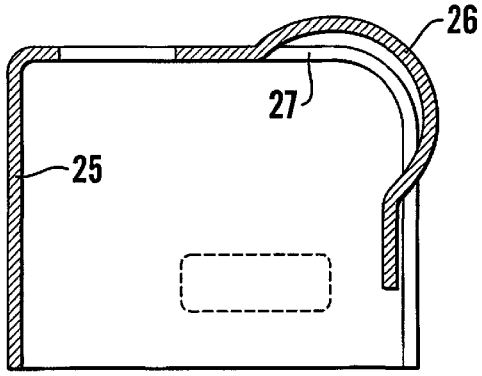
FIGS. 3A and 3B are a side cross sectional view and top plan view respectively of the shield of the lighter.
Figure 3B:
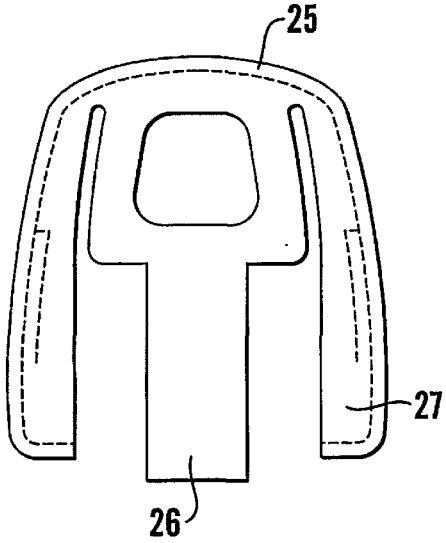

FIGS. 3A and 3B are side and top views of the cap or shield 25, showing an embodiment of the central tongue 26. The shield is formed from a single sheet of metal which is suitably cut and bent. The shield also has two outer portions 27 which are located outside the thumb wheels 16.

The shield may be made of any suitable material having the required stiffness. As described above it is made to be relatively stiff, so that during use the user's thumb tends to deform around the shield portion to engage the thumb wheels.

In a second preferred embodiment, the tongue is relatively flexible so that it deflects when pressed by the user. In this case the user's thumb acts against the tongue 26 of the cap 25 and causes it to deflect. This deflection is subject to a restoring force which acts against the user's thumb and tends to prevent the user's thumb from achieving sufficient contact on the thumb wheels 16. The user's thumb will press the tongue 26 and the thumb wheels 16 downwardly due to the length of the elongate hole 32. When the wheel assembly axle 31 has reached the bottom part of the hole 32, rotation can be achieved despite the tongue 26 by means of the user's thumb pressing down sufficiently hard to overcome the restoring force of the tongue 26 to such an extent that the thumb wheel 16 is gripped by the thumb.

The shield may be made of any suitable material having the required resilience to confer the desired child resistance effect. As described above it is formed to be resilient, that is to say deformable, causing it to be depressed by the user's thumb during use, after downwards movement of the thumbwheel.

In both of the above embodiments, as soon as the wheel assembly is released, it comes back to its initial position under the force of the flint spring 19.

The exact position of the tongue 26 relative to the thumbwheels is chosen depending on its degree of flexibility or rigidity to give the lighter the required degree of child resistance, as determined by the test referred to above. The tongue may conveniently be formed by stamping from metal sheet, and its exact degree of resilience will then depend on the characteristics of the metal and the design of the tongue. The degree of child resistance of the lighter is sensitive to relatively small changes in these parameters; however, it is found to be difficult in practice to adjust and maintain these parameters within close limits during prototyping and production.

The lighter therefore benefits in that its degree of child resistance, and consequently the degree of difficulty experienced in using it, is determined by the parameters of the tongue 26 in combination with the reciprocal motion of the wheel assembly 13, which is upwardly biased against the user's digit by the spring 19. The interaction between all of these components permits a more accurate and easy adjustment of the child resistance of the lighter, for example by adjusting the length or stiffness of the spring 19, permitting greater consistency in production.

Figure 4:
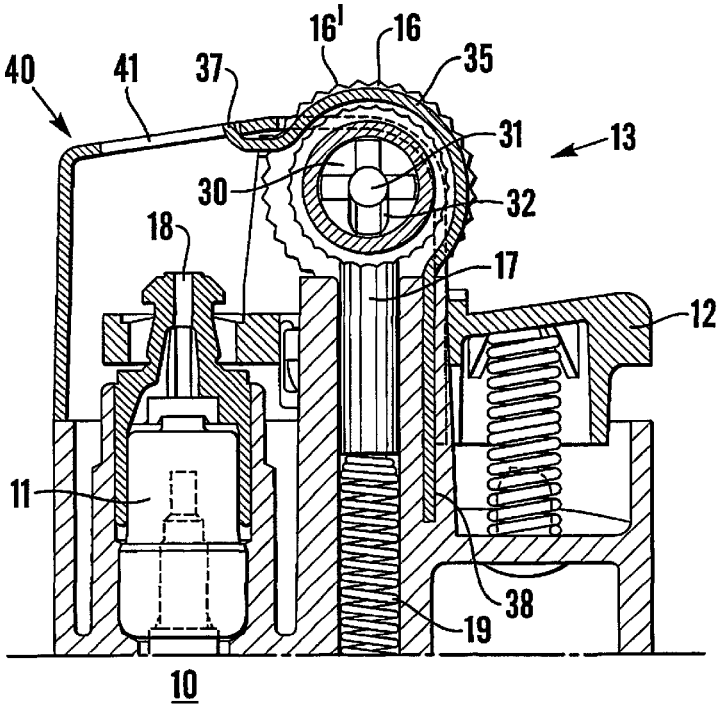
FIG. 4 is a side cross sectional view of a second lighter in the rest position.

FIG. 4 is a view of a second lighter. This is similar to the lighter of FIGS. 1–3, and corresponding components have the same reference characters. However, in place of the shield of the first lighter, there is a two-part shield assembly comprising a shield element 40 and a tongue element 35.

Figure 5:
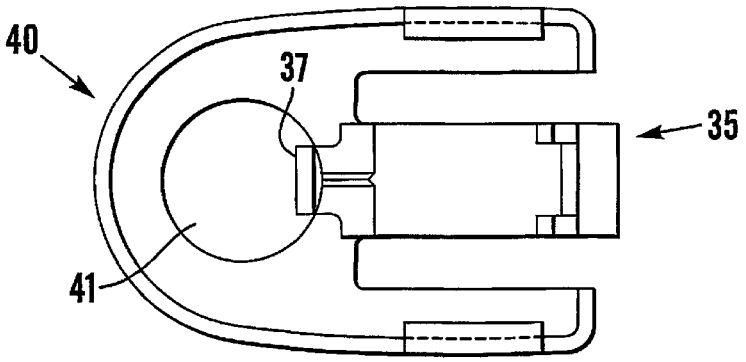
FIGS. 5, 6A, 6B and 6C are various views of the shield assembly of the second lighter.

FIG. 5 shows the shield element 40, which forms a housing around the burner 18 and the sides of the lighter including the ears 30. This shield element has an aperture 41 as shown through which the flame from the burner 18 emerges.

Figure 6A:
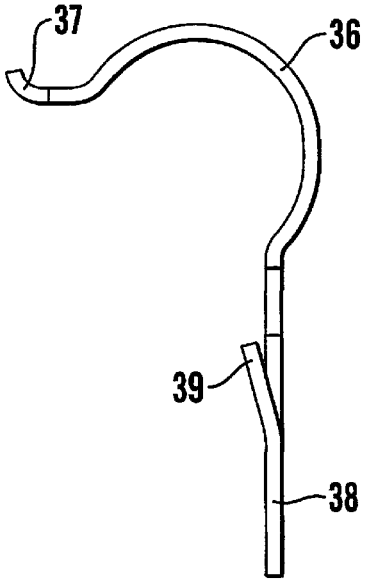
Figure 6B:
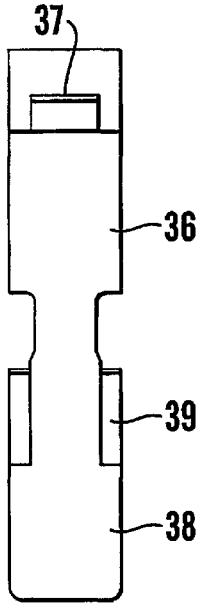
Figure 6C:
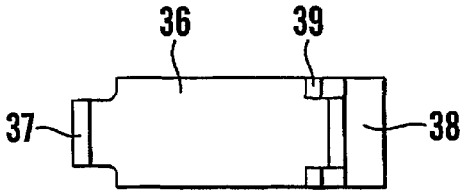

FIG. 6A is a side view of the tongue element 35, and FIGS. 6B and 6C are end and top views of this element. This element comprises a tail 38, a curved body part 36, and a hook element 37, and the tail 38 has a pair of tangs 39. The curved body part 36 passes around the spark wheel 15 in the same way as the tongue 26 of the first lighter. The tail 38 engages in the lighter body through an aperture (not shown) in the lever 12 and immediately behind the flint 17, and is retained in that position by the tangs 39. The hook 37 engages under the shield element 40 and emerges through the aperture 41 as shown. The tail 38 and hook 37 together hold the tongue element 35 firmly in place. This tongue element operates in the same way as the tongue 26 of the first lighter.

The advantage of this embodiment is that a conventional shield 40 may be used, reducing tooling and production costs.

In all of the abovedescribed embodiments the outer peripheral surfaces 16' of the thumbwheels 16 are knurled, serrated or otherwise roughened as typical in the prior art, to enable the user's digit more easily to achieve the degree of frictional engagement required to induce rotation. However, by making these outer peripheral surfaces 16' smooth, with either a circular or an undulating profile, the pressure required to be exerted by the user's digit may be increased to such a degree as to make the lighter effectively childproof, as shown in the present applicant's French Patent No. 95 08011.

It has been found that by combining the guard tongue 26, 35 as taught in the abovedescribed embodiments with smooth rather than knurled or roughened thumbwheels, the required degree of child resistance may be more reliably and accurately achieved than by either method alone.

Figure 7A:
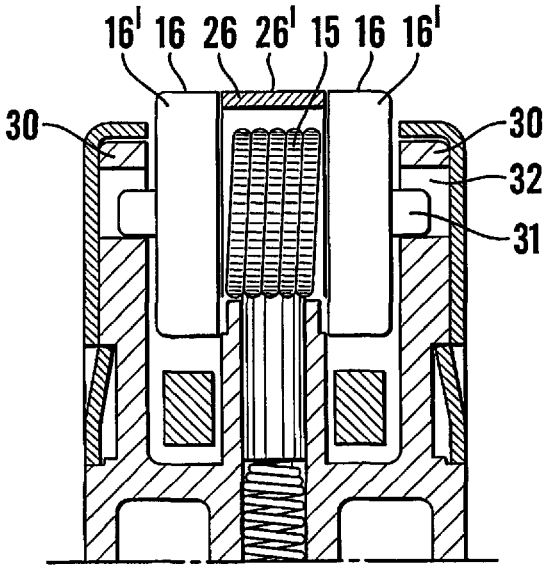
FIGS. 7A and 7B are end and side views (in cross section) of a lighter substantially as shown in FIGS. 1A and 1B, but with smooth rather than roughened thumbwheels.
Figure 7B:
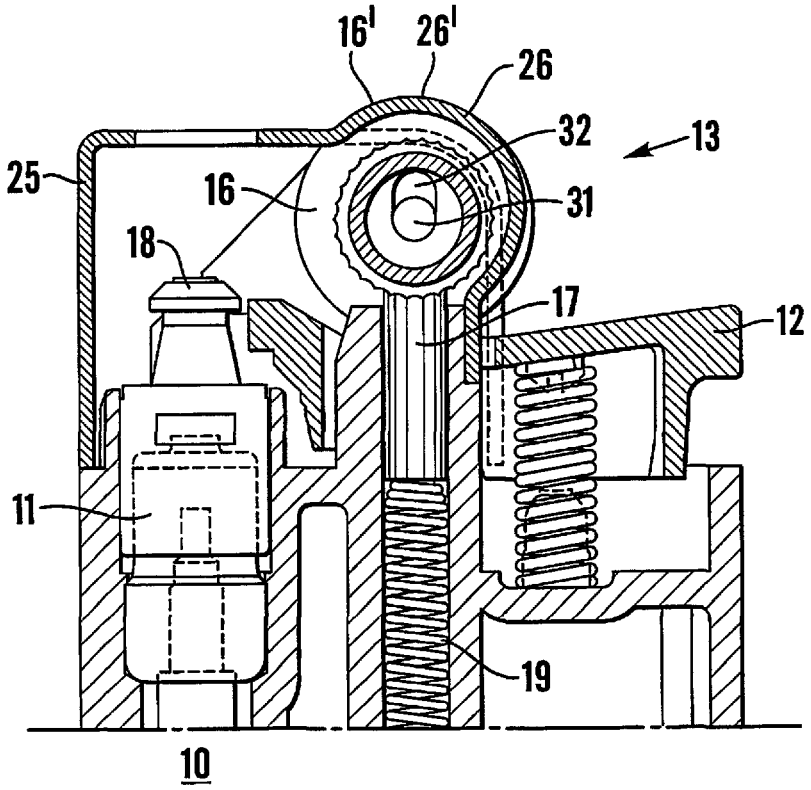

Referring to FIGS. 7A and 7B, in a further alternative embodiment, a lighter is formed as shown in FIGS. 2A and 2Bb, but the outer peripheral surfaces 16' of the thumbwheels are smooth and circular. The tongue 26 is positioned with its outer face 26' closely adjacent the outer peripheral surfaces 16' of the thumbwheels 16.

In use, the outer peripheral surfaces 16' are engaged by the user's digit (typically the thumb) to rotate the thumbwheels and operate the lighter. The tongue 26 is so positioned with respect to these surfaces 16' that during this operation the user's digit is impeded by the outer face 26' of the tongue, and the user must therefore exert a greater pressure on the thumbwheels 16 in order to obtain the required frictional engagement with their outer peripheral surfaces 16' to induce rotation. It is therefore the precise positioning of the tongue 26 relative to the position of the outer peripheral surfaces 16' of the thumbwheels, in combination with the reduced friction of the smooth surfaces of the thumbwheels, which imparts to the lighter its child resistance, and conversely which determines its ease of operation by an adult user.

Figure 7C:
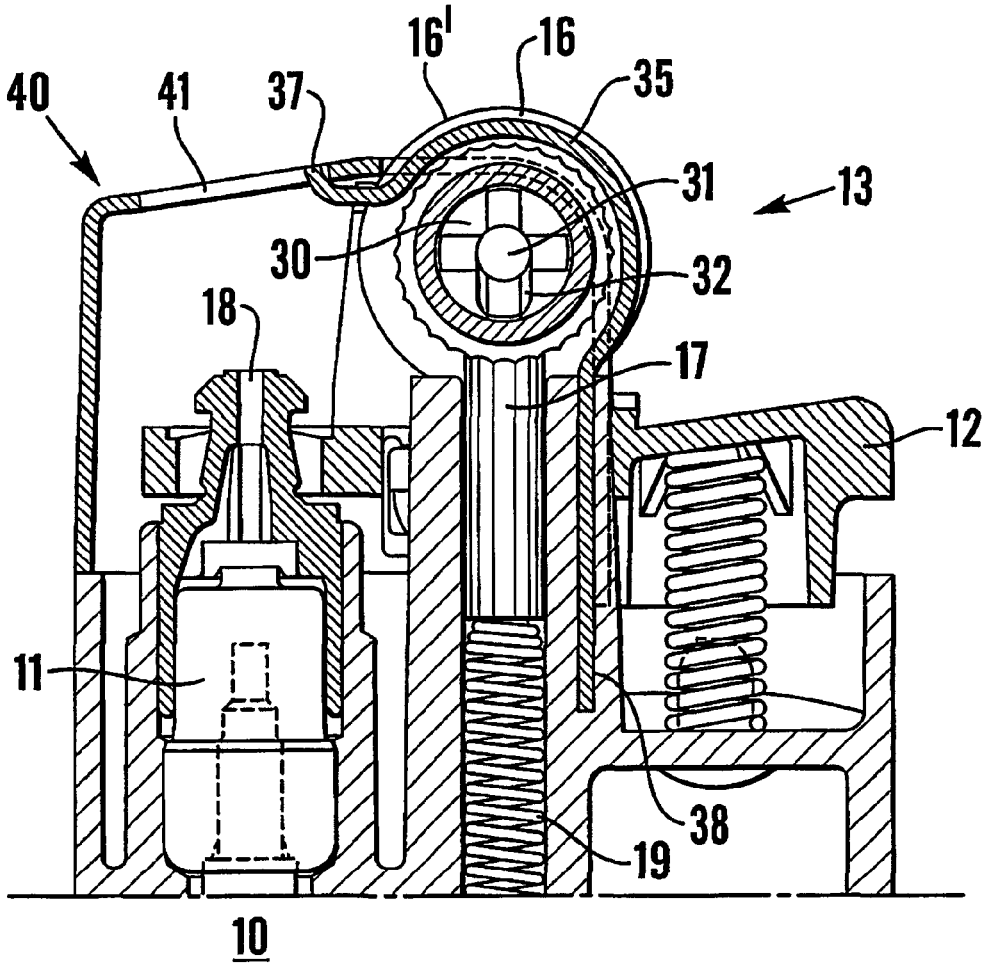
FIG. 7C is a side view also in cross section, of a lighter substantially as shown in FIG. 4, but with smooth rather than roughened thumbwheels.

This principle may equally well be applied to the lighter described above with reference to FIG. 4, and this arrangement is shown in FIG. 7C, the tongue 35 again being arranged closely adjacent the outer peripheral surfaces 16' of the thumbwheel 16 and the outer peripheral surfaces 16' of the thumbwheels again being smooth and circular.

Figure 8A:
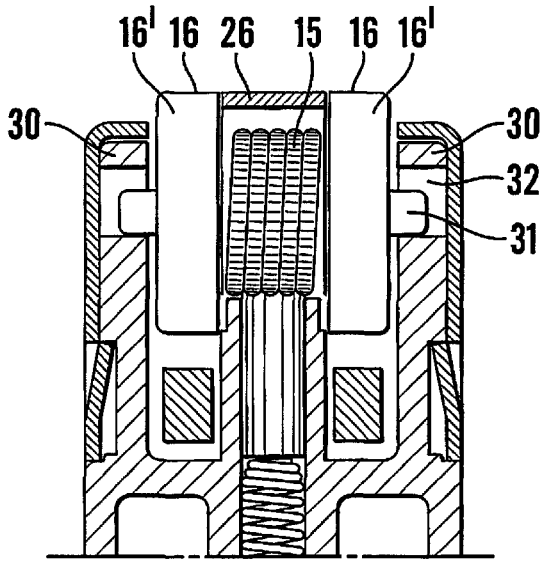
FIGS. 8A, 8B and 8C are end and side views in section of lighters substantially as shown in FIGS. 1A, 1B and 4 respectively, but with smooth thumbwheels having an undulating profile.
Figure 8B:
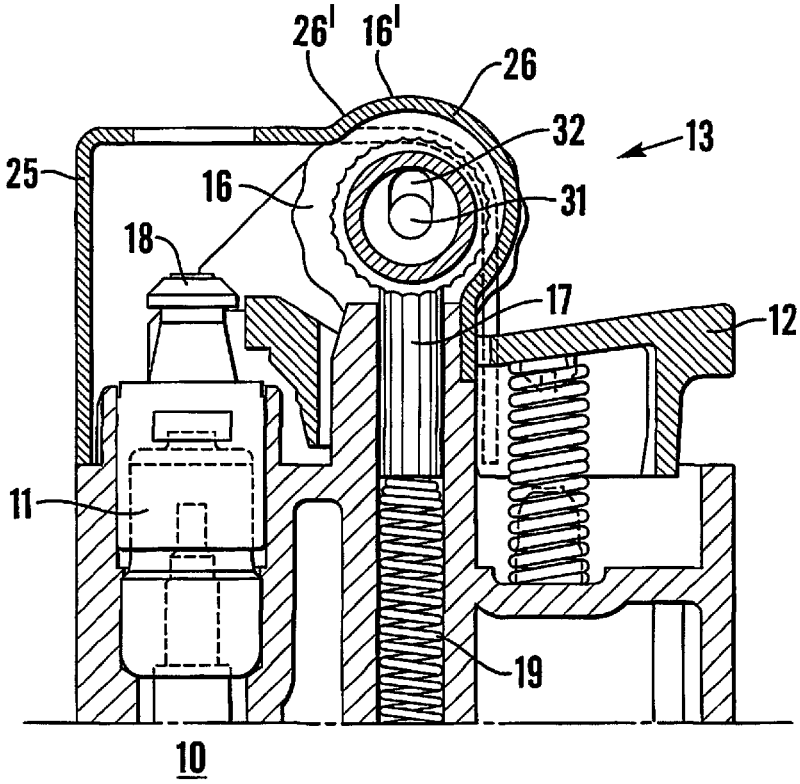
Figure 8C:
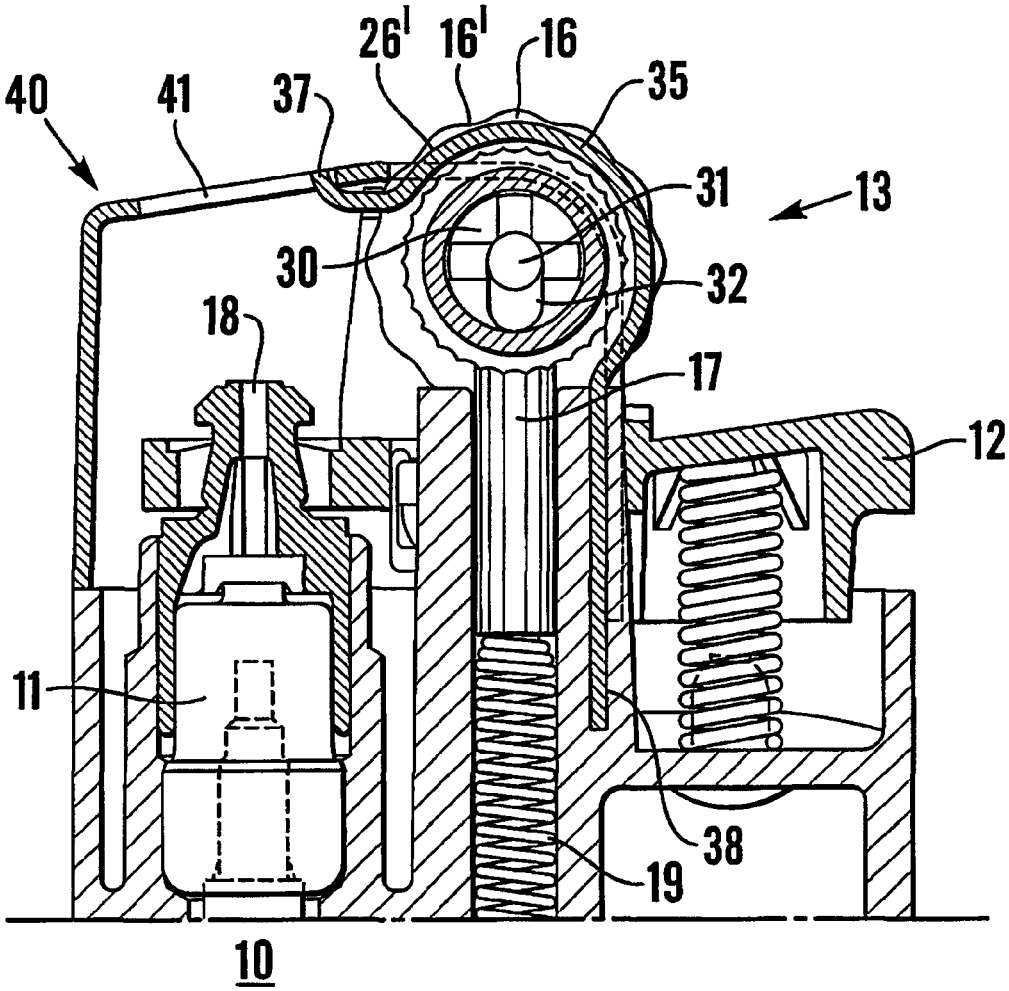

Similarly, FIGS. 8A, 8B and 8C respectively show a lighter as described above with reference to FIGS. 2A, 2B and 4, but equipped instead with thumbwheels 16 whose outer peripheral surfaces 16' are smooth and have an undulating profile. The tongue 26, 35 again may be either flexible or rigid. The child resistance of the lighter is enhanced by the reduced friction provided by the smooth and undulating surface of the thumbwheels, combined with the action of the tongue 26, 35 in impeding the action of the user's digit.

In all of the above embodiments the thumbwheel is arranged as two wheels one on each side of a central spark wheel with the guard tongue 26, 35 arranged between the thumb wheels and covering the spark wheel. However, the guard tongue could be arranged alongside a thumbwheel on the outside of it.

30 thumbwheels, which imparts to the lighter its child resistance, and conversely which determines its ease of operation by an adult user.

What is claimed is:

1. A child resistant lighter of the roll and press type comprising:

a wheel assembly having a spark wheel and at least one thumb wheel flanking the spark wheel;

a shield having a protective strip around the wheel assembly and interacting therewith to make the wheel assembly difficult for children to rotate, said shield being located below a top of said wheel assembly in an undepressed state thereof; and a resilient mount for the wheel assembly enabling resilient downward movement of the wheel assembly so that the user has to press the wheel assembly downwards before it can be rotated and whereby a digit of the user engages the protective strip during the downward movement.

2. A child resistant lighter according to claim 1 wherein the peripheral surface of the thumbwheel means is smooth.

3. A child resistant lighter according to claim 2 wherein the peripheral surface of the thumbwheel means is undulating.

4. A child resistant lighter according to claim 1 wherein in that the protective strip is relatively stiff.

5. A child resistant lighter according to claim 1 wherein the protective strip is resilient.

6. A child resistant lighter according to claim 1 wherein the protective strip is integral with a shield extending around a burner of the lighter.

7. A child resistant lighter according to claim 1 wherein the protective strip in a separate element engaging with a shield extending around a burner of the lighter at one end of the protective strip and with a body of the lighter at another end of the protective strip.

* * * * *